US006491384B2

(12) United States Patent
Usui et al.

(10) Patent No.: US 6,491,384 B2
(45) Date of Patent: Dec. 10, 2002

(54) INK JET PRINTER HEAD

(75) Inventors: Takahiro Usui, Suwa (JP); Satoru Miyashita, Suwa (JP); Tatsuya Shimoda, Suwa (JP); Satoshi Inoue, Suwa (JP)

(73) Assignee: Seiko Epson Corporation (JP)

( * ) Notice: Subject to any disclaimer, the term of this patent is extended or adjusted under 35 U.S.C. 154(b) by 59 days.

(21) Appl. No.: 09/749,892

(22) Filed: Dec. 29, 2000

(65) Prior Publication Data

US 2001/0015739 A1 Aug. 23, 2001

Related U.S. Application Data

(62) Division of application No. 09/010,622, filed on Jan. 22, 1998, now Pat. No. 6,186,618.

(30) Foreign Application Priority Data

Jan. 24, 1997 (JP) ..... 9-11724

(51) Int. Cl.[7] ..... B41J 2/045
(52) U.S. Cl. ..... 347/70; 347/71
(58) Field of Search ..... 347/40, 44, 47, 347/70, 68, 71, 72, 69; 216/27

(56) References Cited

U.S. PATENT DOCUMENTS 5,185,055 A 2/1993 Temple et al.
5,229,785 A 7/1993 Leban
5,374,332 A 12/1994 Koyama et al.
5,453,767 A * 9/1995 Chang et al. ..... 347/10
5,560,837 A 10/1996 Trueba
5,739,832 A * 4/1998 Heinzl et al. ..... 347/68
5,790,139 A * 8/1998 Umeno et al. ..... 347/10
5,870,123 A 2/1999 Lorenze, Jr. et al.
5,933,167 A 8/1999 Shimada et al.
5,940,099 A 8/1999 Karlinski
5,988,799 A 11/1999 Abe et al.
6,186,618 B1 * 2/2001 Usui et al. ..... 347/70

FOREIGN PATENT DOCUMENTS

JP 05-238013 9/1993
JP 06-071895 3/1994
JP 06-278279 10/1994
JP 08-118661 5/1996
JP 09-174859 7/1997

* cited by examiner

*Primary Examiner*—Robert Beatty
(74) *Attorney, Agent, or Firm*—Harness, Dickey & Pierce, P.L.C.

(57) ABSTRACT

An ink jet printer head having a base, an ink reservoir, an ink pressure generating chamber, a piezoelectric element separating the reservoir and chamber and having a hole connecting the reservoir and chamber, and a transistor formed opposite the piezoelectric element relative to the ink reservoir for operating the piezoelectric element.

10 Claims, 5 Drawing Sheets

INK JET PRINTER HEAD

This application is a division of 09/010,622 filed Jan. 22, 1998 now U.S. Pat. No. 6,186,618.

BACKGROUND OF THE INVENTION

1. Field of the Invention

The present invention relates to an ink jet printer head featuring the use of a piezoelectric thin film as a drive source for ink discharge, and to a method for manufacturing the same.

2. Description of the Related Art

Examples of electromechanical transducer elements serving as a drive source for liquid or ink discharge include piezoelectric ink jet printer heads featuring the use of a piezoelectric thin film consisting of PZT. Such a printer head can be manufactured by the following process, for example, using an etching technique.

A silicon thermal oxide film, a common electrode serving as an vibrating plate, a piezoelectric thin film, and a top electrode are formed, in that sequence, on a silicon substrate which is to be used as the ink jet base. The piezoelectric thin film and top electrode are then patterned using a negative resist, and a piezoelectric element is thus formed by means of the common electrode, piezoelectric thin film, and top electrode. Anisotropic etching of the underside of the head base (the side opposite where the piezoelectric thin film is formed) results in the formation of 0.1 mm wide ink pressure generating chambers, ink supply channels that supply ink to the ink pressure generating chambers, and an ink reservoir that is connected to the ink supply channels; and a nozzle plate is connected, in which nozzle holes have been formed to discharge the ink to locations corresponding to the ink pressure generating chambers.

However, the process for forming patterns including such a piezoelectric thin film on an ink jet base is carried out at elevated temperatures, resulting in the need for quartz glass as well as a silicon substrate with excellent heat resistance for the ink jet base.

Such silicon substrates and quartz glass are scarce and extremely expensive materials, however, and they are also brittle and quite susceptible to cracking. This results in poor manufacturing yields and higher costs.

There has also been recent demand for more precise formation of ink jet nozzle holes to achieve higher density in the dot patterns of ink jet printer heads, but it has been difficult for the following reasons to manufacture nozzle plates in conventional methods in order to meet such demand. Conventionally, SUS plates with a thickness t of 100 to 60 $\mu$m have been punched to make holes. Fine holes not only make the punching process more difficult, and also result in a lower punch life.

SUMMARY OF THE INVENTION

An object of the present invention is thus to provide an ink jet printer head in which the material for the ink jet base is not limited, as well as a method for manufacturing the same. Another object of the present invention is to provide a method for manufacturing an ink jet printer head allowing greater dot pattern density to be achieved, as wall as an ink jet printer head that is manufactured by this manufacturing method.

The applicant has proposed a method in which a separable material on a substrate with a separation layer interposed between them is separated from the substrate, wherein the separation layer is irradiated with light to effect the separation in the interior layer of the separation layer or at the interface, and has also proposed that this method could be applied for piezoelectric element actuators (Japanese Patent Application 8-225643).

The present application is intended for application in methods of manufacturing ink jet printer heads, and is intended to provide a method for manufacturing an ink jet printer head in which a piezoelectric element and an vibrating plate for pressurizing the ink in an ink pressure generating chamber is formed on an ink jet base on which the ink pressure generating chambers are formed, wherein the method for manufacturing an ink jet printer head comprises the steps of forming the piezoelectric element and the vibrating plate on the substrate with a separation layer interposed therebetween; of bonding the substrate and the ink jet base; and of irradiating the separation layer with light so that the substrate is separated from the vibrating plate, on which the piezoelectric element has been established, at the separation layer, and of joining the vibrating plate with the ink jet base, thereby achieving the objectives described above.

The piezoelectric element has a structure in which the piezoelectric thin film is sandwiched between electrodes, although a variety of electrode configurations can be considered.

The present invention is also characterized by an ink jet printer head formed by these processes, as well as by printers so equipped.

This method allows the ink jet base to be formed by a different process than the process for forming the piezoelectric thin film, and thus allows the ink jet base to be formed without being limited to conventional materials or manufacturing methods.

Methods that can be used during the formation of the ink jet base include a method of formation using photosensitive glass, a method of formation using a photosetting resin, a method of formation using electroformation, or a method of formation using a stamper. These methods can be used to integrally form a conventional nozzle plate with the ink jet base, and to form ink jet nozzle holes in higher density dot patterns.

Quartz glass is preferably used as the substrate in the present invention.

DESCRIPTION OF THE PREFERRED EMBODIMENTS

Embodiments of the present invention are described below. The embodiments are described with reference to the drawings in order to facilitate understanding.

Description of Substrate

Figure 3A:
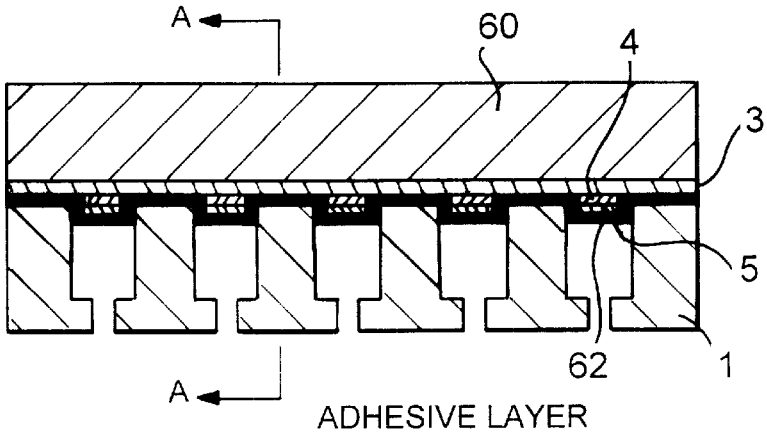
FIG. 3 is a cross section of the film structure during the process for bonding the substrate and the ink jet base and then separating the substrate.

The substrate is indicated by the symbol 60 in FIG. 3A. After the ink jet base and the piezoelectric thin film etc. formed in the surface of the substrate have been joined, the substrate is separated and removed at the separation layer formed between the substrate and the common electrode 2. The separation at the separation layer is brought about by irradiating the separation layer with prescribed light. This is described in further detail below.

The substrate should be one that is sufficiently light-transmissive to allow radiated light to pass through. The radiated light transmissivity in this case is preferably at least 10%, and even more preferably at least 50%. A transmissivity that is too low results in substantial radiated light loss, requiring greater quantities of light to separate the separation layer.

The substrate should be composed of a material that is highly reliable, and should in particular be composed of a material with excellent heat resistance. Depending on the type and the method of formation, the process temperature is sometimes higher (about 400 to 900° C., for example) during the formation of the electrode layers for the piezoelectric thin film, the PZT thin film (piezoelectric thin film), and the vibrating plate described below (hereinafter, these are sometimes referred to collectively as "transfer layer"). That is because in such cases there is a wide range for setting the film-forming conditions such as the temperature conditions during the formation of the vibrating plate or the like on the substrate when the substrate has excellent heat resistance.

The substrate should be composed of a material with a distortion point at or beyond Tmax, where Tmax is the maximum temperature during the formation of the transfer layers. Specifically, the structural material of the substrate 60 should have a distortion point of at least 350° C., and even more preferably at least 500° C. Examples of such materials include quartz glass, soda glass, Corning 7059, Nippon Electric Glass OA-2, and other such heat resistant glass. Quartz glass has excellent heat resistance (the distortion point of quartz glass is 1000° C., as opposed to 400 to 600° C. for common glass) and can be used to form the TFT described below in high temperature processes, making it particularly desirable.

The substrate thickness is not particularly limited, although usually it is preferably about 0.1 to 5.0 mm, and even more preferably about 0.5 to 1.5 mm. A substrate that is too thin leads to lower strength, whereas one that is too thick tends to result in radiated light loss when the substrate has a low transmissivity.

When the substrate has a high radiated light transmissivity, the thickness may be outside the aforementioned limits. The thickness of the substrate where the separation layer is formed should be uniform so as to allow the radiated light to be uniformly radiated.

Description of Separation Layer

The separation layer has the property of absorbing the radiated light landing on the substrate side so as to bring about separation in the layer and/or at the interface (hereinafter referred to as "separation in the layer" and "separation at the interface"), preferably leading to separation in the layer and/or separation at the interface when the radiation of light results in the disappearance or diminishment of the interatomic or intermolecular bonds of the substance constituting the separation layer, that is, in ablation or the like.

As a result of the light radiation, gas is sometimes released from the separation layer, producing a separation effect. That is, components contained in the separation layer sometimes turn into gases and are released, while the separation layer sometimes absorbs the light, instantly producing gas and releasing vapor which is involved in the separation.

The following are examples of compositions for such a separation layer.

(1) Amorphous silicon (a-Si)

Amorphous silicon may contain H (hydrogen). In this case, the H content should be about 2 at % or more, and more preferably about 2 to 20 at %. When the H is contained in the prescribed amount, the hydrogen is released as a result of light irradiation, and internal pressure is produced in the separation layer, providing force to separate the thin film above and below.

The H content of the amorphous silicon can be adjusted by setting the film-forming conditions as desired, such as the CVD gas composition, gas pressure, gas atmosphere, gas flow rate, temperature, substrate temperature, or applied power.

(2) Silicon oxide or silicic acid compounds, titanium oxide or titanic acid compounds, zirconium oxide or zirconic acid compounds, lanthanum oxide or lanthanic acid compounds and various other oxide ceramics, dielectrics (ferroelectrics), or semiconductors.

Examples of silicon oxide include SiO, $SiO_2$, and $Si_3O_2$. Examples of silicic acid compounds include $K_2SiO_3$, $Li_2SiO_3$, $CaSiO_3$, $ZrSiO_4$, and $Na_2SiO_3$.

Examples of titanium oxide include TiO, $Ti_2O_3$, and $TiO_2$. Examples of titanic acid compounds include $BaTiO_4$, $BaTiO_3$, $Ta_2Ti_9O_{20}$, $BaTi_5O_1$, $CaTiO_3$, $SrTiO_3$, $BpTiO_3$, $MgTiO_3$, $ZrTiO_2$, $SnTiO_4$, $Al_2TiO_5$, and $FeTiO_3$.

Examples of zirconium oxide include $ZrO_2$. Examples of zirconic acid compounds include $BaZrO_3$, $ZrSiO_4$, $PbZrO_3$, $MgZrO_3$, and $K_2ZrO_3$.

(3) Silicon nitride, aluminum nitride, titanium nitride, and other nitride ceramics.

(4) Organic macromolecular materials

Examples of organic macromolecular materials include those with bonds such as —$CH_2$—,—CO—(ketones),—CONH—(amides),—NH—(imides),—COO—(esters), —N═N—(azos) and —CH═N—(schiffs), and particularly any with an abundance of such bonds.

The organic macromolecular material may be one with aromatic hydrocarbons (one or more benzene rings or condensed rings) in the structural formula.

Specific examples of such organic macromolecular materials include polyethylene, polypropylene and other such polyolefins, polyimides, polyamides, polyesters, polymethyl methacrylate (PMMA), polyphenylene sulfide (PPS), polyether sulfone (PES), and epoxy resins.

(5) Metals

Examples of metals include Al, Li, Ti, Mn, In, Sn, Y, La, Ce Nd Pr, Gd, Sm, or alloys containing at least one of these.

Known materials that are resistant to the process temperature during the formation of the ink jet printer head may be selected as desired for the separation layer. The separation layer is preferably amorphous silicon.

The thickness of the separation layer varies depending on the object of the separation, the composition of the separation layer, the layer structure, the method of formation, and other such conditions, but usually is preferably about 1 nm to 20 μm, more preferably about 10 nm to 2 μm, and even more preferably about 40 nm to 1 μm.

A separation layer that is too thin sometimes results in the loss of film uniformity and irregular separation, whereas a film that is too thick results in the need for more radiated light power (light quantity) to ensure good separation of the separation layer, and takes more time in the subsequent removal of the separation layer. The separation layer thickness should also be as uniform as possible.

The method for forming the separation layer is not particularly restricted, and may be selected as desired depending on conditions such as the film composition or film thickness. Examples include CVD (including MOCVD, low pressure CVD, and ECR-CVD), deposition, molecular beam deposition (MB), sputtering, ion plating, PVD and a variety of other such vapor phase film-forming methods, electroplating, dipping, elactroless plating and various other such plating methods, the Langmuir-Blodgett (LB) method, spin coating, spray coating, roll coating and other such coating methods, various printing methods, transfer methods, ink jet methods, and powder jet methods. Two or more of these can be combined to form the layer.

When the separation layer is an amorphous silicon (a-Si) composition, for example, the layer can be formed by CVD, and particularly by low pressure CVD or plasma CVD. When the separation layer is a ceramic obtained by the sol-gel method, or when it is an organic macromolecular material, the layer is preferably formed by a coating method, particularly spin coating. The separation layer may also be formed in two or more processes (such as a layer forming process and a heating process).

An interlayer (underlayer) may also be formed between the separation layer and the common electrode 3. The interlayer may be formed for various molding purposes. Examples include those with one or more functions, such as protective layers for physically or chemically protecting transfer layers during manufacture or use, insulating layers, barrier layers for inhibiting the migration of components to or from a transfer layer, and reflective layers.

The composition of the interlayer may be selected as desired according to the purpose for which it is formed. Examples include silicone oxide such as $SiO_2$ for interlayers that are formed between a transfer layer and a separation layer of amorphous silicon. Other examples for interlayers include metals such as Pt, Au, W, Ta, Mo, Al, Cr, Ti, or alloys consisting primarily of these.

The thickness of the interlayer may be determined as desired according to the purpose for which it is formed or the degree to which the function can be brought about, but usually is preferably about 10 nm to 5 μm, and even more preferably about 40 nm to 1 μm. Examples of methods for forming the interlayer include the same methods given as examples for forming the aforementioned separation layer. The interlayer may also be formed by two or more processes. Two or more interlayers can be formed with the same or different compositions. The transfer layers may also be formed directly on the separation layer without forming an interlayer in the present invention.

FIG. 3 depicts an adhesive layer 62 formed on the surface of a transfer layer, and the transfer layer bonded (joined) to the ink jet base 1 with the adhesive layer interposed therebetween. Desirable examples of adhesives for the adhesive layer include reactive curing types of adhesives, thermosetting adhesives, ultraviolet ray setting adhesives and other such photosetting adhesives, anaerobic curing adhesives and various other curing types of adhesives. The composition of the adhesive may be, for example, any that is epoxy-based, acrylate-based, silicone-based, or the like. The adhesive layer may be formed by a coating method, for example.

When the aforementioned curing type of adhesive is used, a transfer layer, for example, is coated with the curing type of adhesive, the ink jet base is bonded thereto, and the aforementioned curing type of adhesive is cured by a curing method suited to the properties of the curing type of adhesive so that the transfer layer and ink jet base are adhesively fixed to each other.

Figure 5:
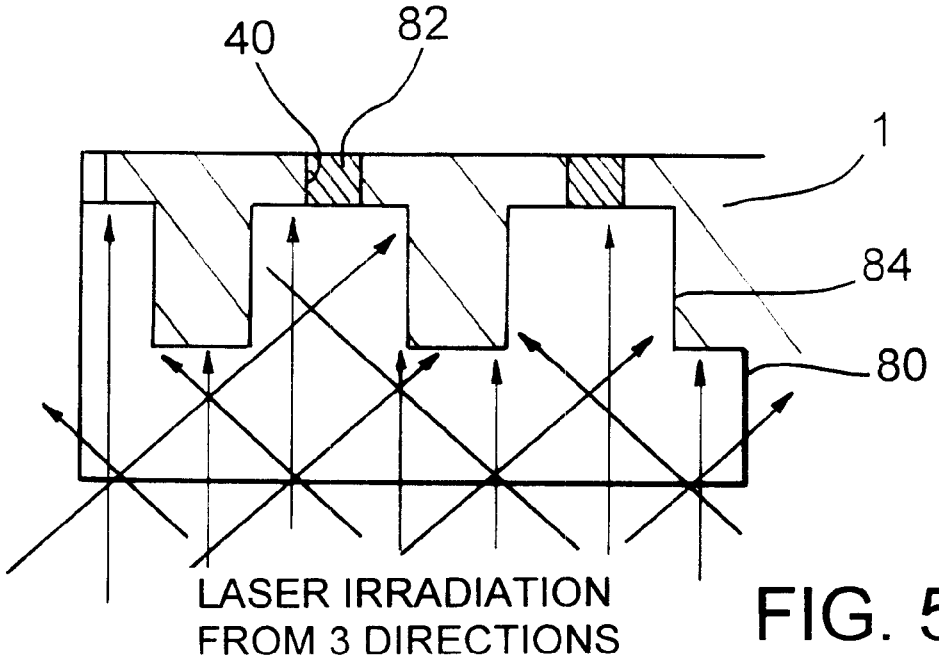
FIG. 5 is a schematic depicting another manufacturing example of the ink jet base.

When a photosetting type of adhesive is used, the light-transmitting ink jet base is preferably placed on the uncured adhesive layer, and the ink jet base side is preferably irradiated with curing light to cure the adhesive. When the substrate 60 is light-transmissive, curing can be ensured by irradiating both the substrate side and the base 1 side with curing light to cure the adhesive. This radiation of light in three directions is illustrated in FIG. 5 below.

Unlike in the figure, the adhesive layer may be formed on the base side, and a transfer layer may be allowed to adhere thereon. The interlayer described above may be placed between the transfer layer and adhesive layer.

The properties, such as the heat resistance and corrosion resistance, of the ink jet base may be lower than those of the aforementioned substrate. That is because, in the present invention, a transfer layer is formed on the substrate side, and the transfer layer is then transferred to the ink jet base, so the properties required of the ink jet base, particularly the heat resistance, are not dependent on temperature conditions and the like during the formation of the transfer film.

As such, a material with a glass transition point (Tg) or curing point at or below Tmax can be used for the structural material of the ink jet base, where Tmax is the maximum temperature during the formation of the transfer layer. For example, the ink jet base can be composed of a material with a glass transition point (Tg) or curing point that is preferably no more than 800° C., more preferably no more than 500° C., and even more preferably no more than 320° C.

The mechanical properties of the ink jet base should include a certain degree of rigidity (strength). Examples of structural materials for the ink jet base include various types of synthetic resins or various types of glass materials, and particularly various types of synthetic resins or common (low melting point) inexpensive glass materials. As shown in FIG. 5 below, the formation of the ink jet base using polysilazane allows an ink jet base with satisfactory rigidity to be obtained.

Examples of synthetic resins include any thermoplastic resin and thermosetting resin, such as polyethylene, polypropylene, ethylene-propylene copolymers, ethylene-vinyl acetate copolymers (EVA) and other such polyolefins, cyclic polyolefins, modified polyolefins, polyvinyl chloride, polyvinylidene chloride, polystyrenes, polyamides, polyimides, polyamide imides, polycarbonates, poly-(4-methylpentene-1), ionomers, acrylic resins, polymethyl methacrylate (PMMA), acrylonitrile-butadiene-styrene copolymers (ABS resins), acrylonitrile-styrene copolymers (AS resins), butadiene-styrene copolymers, polyoxymethylene, polyvinyl alcohols (PVA), ethylene-vinyl alcohol copolymers (EVOH), polyethylene terephthalate (PET), polybutylene terephthalate (PBT), polycyclohexane terephthalate (PCT)d and other such polyesters, polyethers, polyether ketones (PEK), polyether ether ketones (PEEK), polyether imides, polyacetals (POM), polyphenylene oxides, modified polyphenylene oxides, polysulfones, polyphenylene sulfides (PPS), polyether sulfones (PES), polyallylates, aromatic polyesters (crystal polymers), polytetrafluoroethylene, polyvinylidene fluoride, other fluororesins, styrene-based, polyolefin-based, polyvinyl chloride-based, polyurethan-based, polyester-based, polyamide-based, polybutadiene-based, transpolyisoprene-based, fluorine rubber-based, chlorinated polyethylene-based and various other thermoplastic elastomers, epoxy resins, phenolic resins, urea resins, melamine resins, unsaturated polyesters, silicone resins, polyurethanes, or copolymers, blends, polymer alloys or the like consisting primarily thereof. These can be used individually or in combinations of two or more (as laminates of two or more layers, for example).

Examples of glass materials include silicic acid glass (quartz glass), alkali silicate glass, soda lime glass, potash lime glass, lead (alkali) glass, barium glass, and borosilicic acid glass. Except for silicic acid glass, these have a lower melting point than silicic acid glass, are relatively easy to form and process, and are inexpensive, making them desirable. The transfer element 6 may also be of metal or ceramics.

Figure 3B:
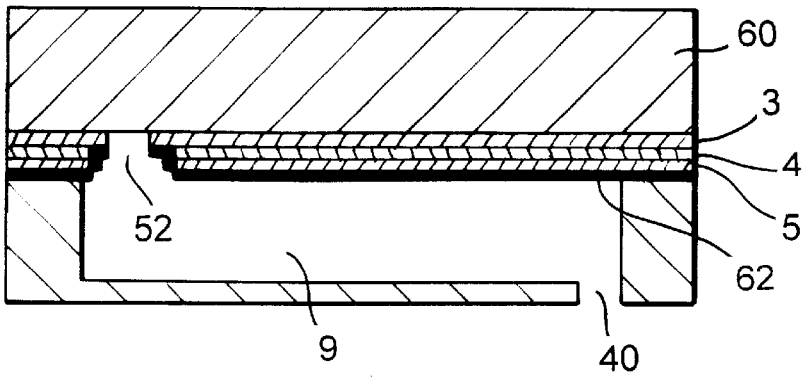
Figure 3C:
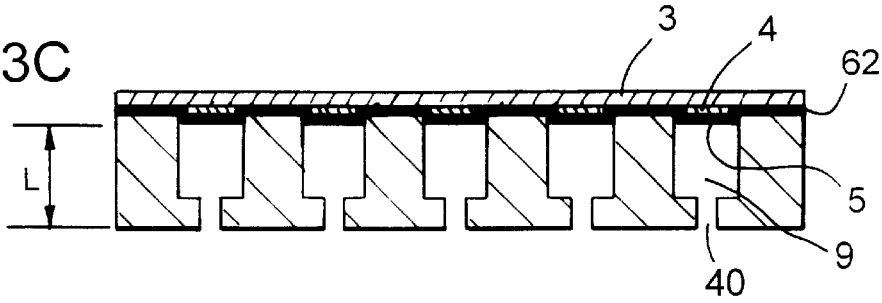
Figure 4:
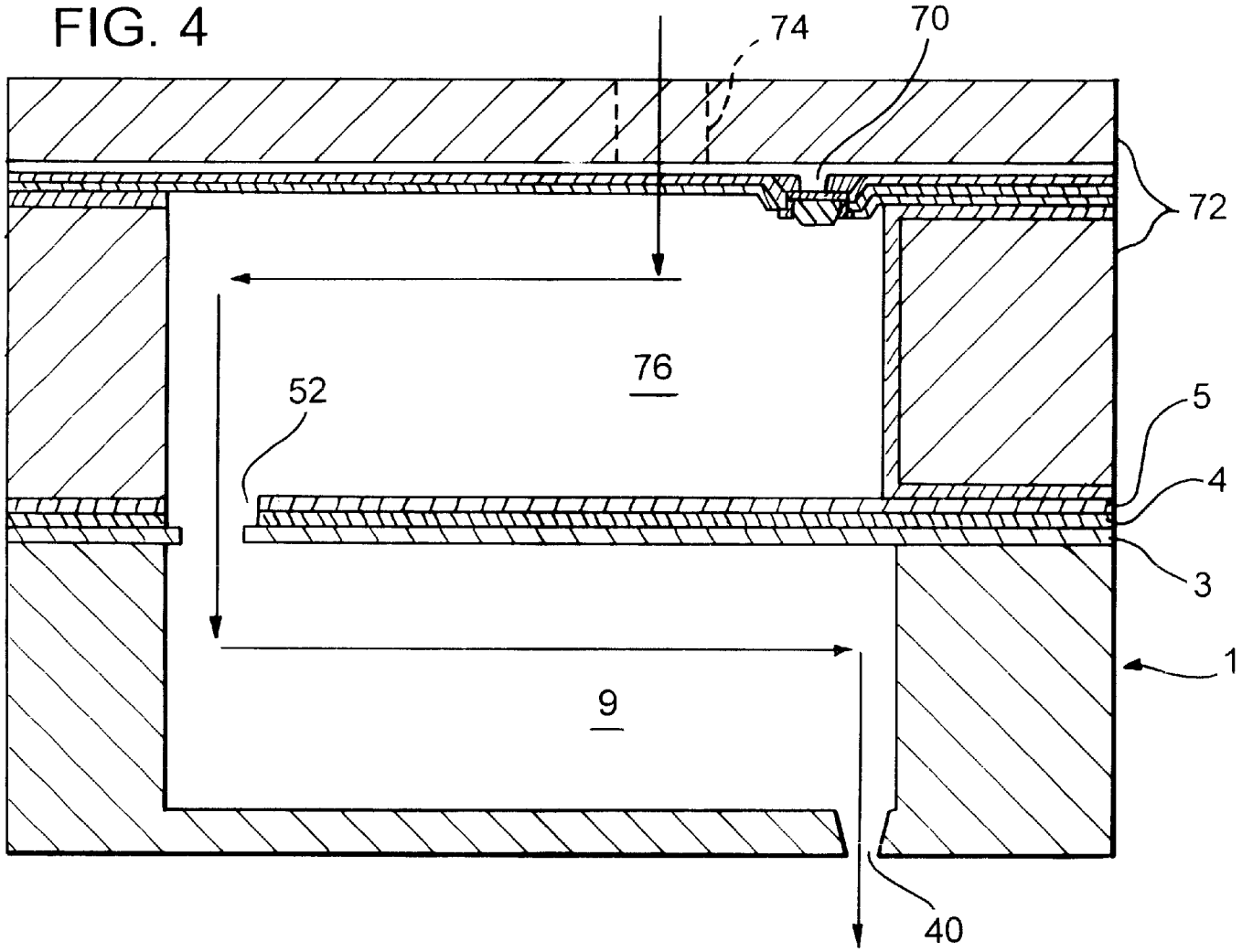
FIG. 4 is a cross section of another ink jet printer head manufactured in an embodiment of the present invention.

The reverse side of the substrate is irradiated with light. The radiated light passes through the substrate and then irradiates the separation layer. As shown in FIG. 3B, this results in separation in the layer and/or at the interface in the separation layer, with a diminishment or loss of bonding strength, so the transfer layer is separated from the substrate and transferred to the ink jet base when the substrate 60 and the ink jet base 1 are separated.

It is assumed that separation in the layer and/or separation at the interface come about in the separation layer because of ablation in the structural material of the separation layer, and because of the release of gas contained in the separation layer as well as phase changes such as fusion and evaporation occurring immediately after irradiation.

Here, ablation refers to the photochemical or thermal excitation of the solid material (structural material of the separation layer) absorbing the radiated light, and the cleavage and release of atomic or molecular bonds at the surface or in the interior, appearing primarily as the phenomenon where some or all of the structural material of the separation layer undergoes a phase change, such as fusion or evaporation (gasification). As a result of the aforementioned phase change, tiny bubbles may result, and the bonding power may be reduced.

Whether the separation layer undergoes separation in the layer, separation at the interface, or both, is a matter governed by the composition of the separation layer and a variety of other reasons, examples of which include the type of irradiation 7, the wavelength, the intensity, the ultimate depth, and other conditions.

The radiated light can be any that brings about separation in the layer and/or separation at the interface in the separation layer, such as X-rays, ultraviolet rays, visible light, infrared rays (heat rays), laser light, millimetric waves, microwaves, electron beams, and radiation ($\alpha$ rays, $\beta$ rays, $\gamma$ rays). Of these, laser light is preferred in view of the ease with which separation (ablation) of the separation layer is brought about.

Examples of laser devices for producing such laser light include various gas lasers and solid lasers (semiconductors laser). Excimer lasers, Nd-YAG lasers, Ar lasers, $CO_2$ lasers, CO lasers, He-Ne lasers, and the like are suitable for use. Of these, excimer lasers are especially preferred.

Excimer lasers output high energy in the short wavelength region, allowing ablation to be brought about in the separation layer in an extremely short period of time. The separation layer can thus be released with virtually no increase in the temperature of adjacent or nearby interlayers, transfer layers, substrates, or the like, that is, with virtually no loss or damage.

The wavelength of the laser light that is radiated should be about 100 to 350 nm in cases of wavelength-dependent light irradiation when ablation is brought about in the separation layer. When separation is the result of phase changes such as the release of gas, gasification, or heating in the separation layer 2, the wavelength of the laser light that is radiated should be about 350 to 1200 nm.

The energy density of the radiated laser light, particularly the energy density in the case of excimer lasers, is preferably about 10 to 5000 mJ/cm$^2$, and more preferably about 100 to 5200 mJ/cm$^2$. The irradiation time is preferably about 1 to 1000 nsec, and even more preferably about 10 to 100 nsec. A low energy density or short irradiation time will not result in adequate ablation or the like, while the radiated light passing through the separation layer and interlayer may adversely affect the transfer layer in cases of a high energy density or long irradiation time.

The radiated light typified by such laser light should be radiated so as to afford uniform intensity. The direction in which the light is radiated is not restricted to the direction perpendicular to the separation layer, but may be a direction at a prescribed angle to the separation layer. When the surface area of the separation layer is greater than that of one instance of irradiation, the light can be radiated over multiple times with respect to the entire region of the separation layer 2. The same location may also be irradiated two or more times. The same or different regions may also be irradiated two or more times with different types of light (laser light) of differing wavelengths (wavelength regions). A separation layer adhering to the interlayer is removed, for example, by a washing, etching, ashing, grinding, or other method, or a combination of these methods. In the case of separation in the layer of the separation layer, the separation layer adhering to the substrate is similarly removed.

When the substrate is made of a scarce material or an expensive material such as quartz glass, the substrate is preferably reused (recycled). The transfer of the transfer layer to the ink jet base is completed via the aforementioned steps.

The interlayer adjacent to the transfer layer can then be removed or another desired layer can be formed or the like. In the present invention, the transfer layer itself which is the material to be removed is not directly separated but is separated at the separation layer adhering to the transfer layer, allowing it to be easily, reliably, and uniformly separated (transferred) irrespective of the properties, conditions, or the like of the material to be separated (transfer layer). The transfer layer can be transferred in a highly reliable manner without damaging the material to be separated (the transfer layer) during the separation operations.

Embodiments

Figure 1A:
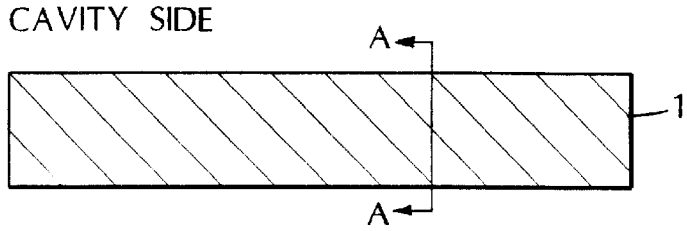
FIG. 1 is a cross section of the film structure during the process for manufacturing the ink jet base in an embodiment of the present invention.
Figure 1B:
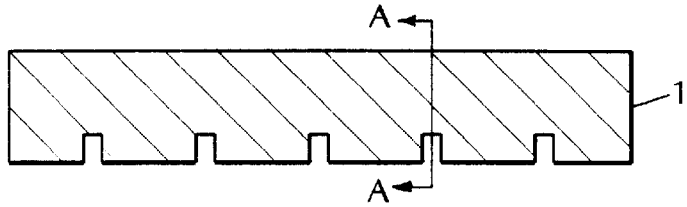
Figure 1C:
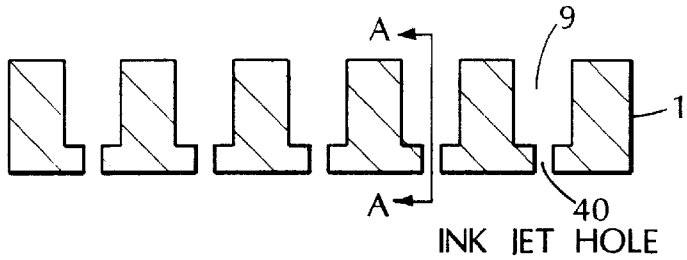
Figure 1D:
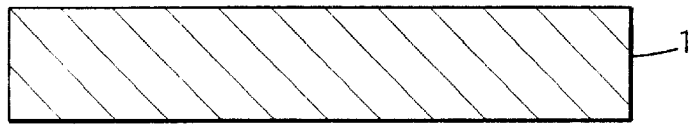
Figure 1E:
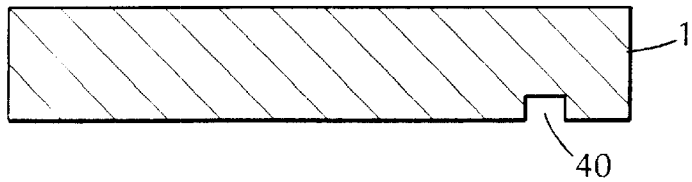
Figure 1F:
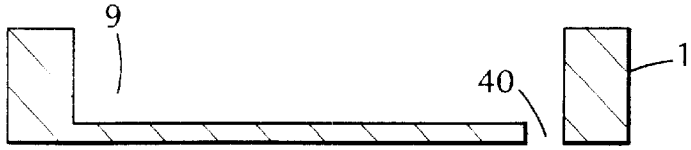
Figures 2E, 2F, 2G, 2H, 2I:
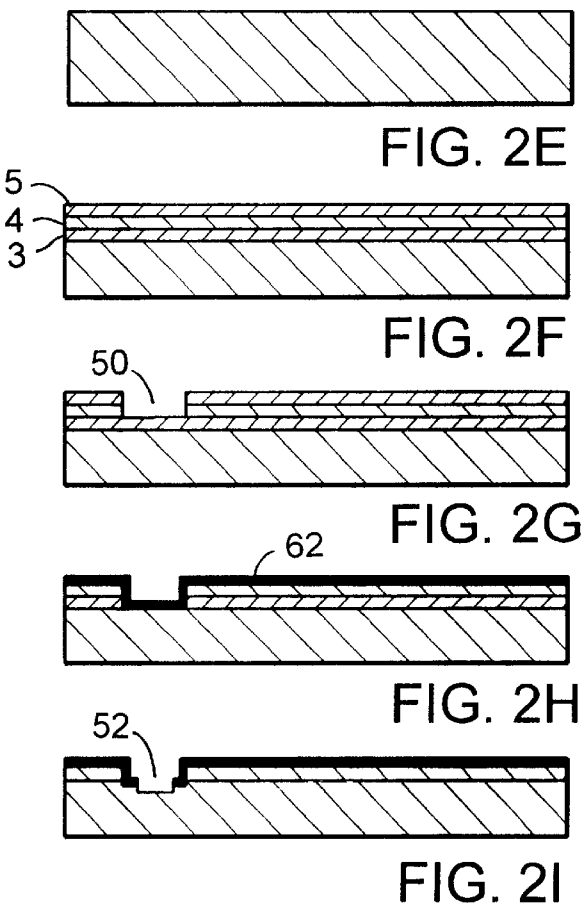
FIG. 2 is a cross section of the film structure during the process for manufacturing the piezoelectric thin film or the like on the substrate in an embodiment of the present invention.

FIGS. 1 through 3 illustrate an example of a method for synthesizing the ink jet printer head pertaining to the present invention. FIG. 1 depicts a step for manufacturing the ink jet base, FIG. 2 depicts a step in which a piezoelectric thin film or the like is formed on the substrate, and FIG. 3 depicts a step in which the substrate and the ink jet base are joined, and the substrate is subsequently removed.

The step in FIG. 1 is described first. Photosensitive glass (such as HOYA Photosensitive Glass PEG3 by Hoya Glass) was used as the matrix starting material to manufacture the ink jet base.

The step in FIG. 1 proceeds from A to C. D is a cross section of line A-A in A, E is a cross section of line A-A in B, and F is a cross section of line A-A in C. A through C are cross sections around the ink jet nozzle 40 of the ink pressure generating chambers 9, and D through F are cross sections in the direction along an ink pressure generating chamber.

The photosensitive glass in this embodiment is silicic acid glass in which metal ions have been dissolved along with a sensitizer. Ultraviolet sensitization and a heat development treatment result in matal colloids, which serve as nuclei for crystal growth.

The crystals are extremely fine and are readily dissolved by acid, enabling fine processing into holes, grooves, external shapes, and other complex configurations.

The nozzle hole 40 pattern is formed on the underside of the photosensitive vitreous matrix using a mask describing the pattern of the ink jet nozzle holes. This is indicated in FIGS. 1B and E. Ink pressure generating chambers 9 are similarly formed using a mask describing the pattern of the ink pressure generating chambers on the upper surface of the photosensitive glass. This is indicated in FIG. 1C.

The process for manufacturing the substrate side is given in FIG. 2, meanwhile.

The step progresses from A to D. E through H are cross sections of line A-A in A through D, respectively. The processes in A and B form the common electrode layer 3, PZT layer 4 in the form of a piezoelectric thin film, and finally a top electrode layer 5 serving as an vibrating plate, in that sequence, on the quartz glass substrate 60, with the separation layer interposed therebetween.

In the process in C, the piezoelectric thin film is then etched according to the pattern for forming the ink pressure generating chambers 9. At this time, as indicated in F, holes 50 are formed to form supply holes for guiding the ink from the ink reservoir to the ink chambers 9. As shown in D and H, the surface of the top electrode 5 is then covered with an adhesive layer 62, and the portions for the aforementioned holes are finally etched in I to form the ink supply holes 52 for supplying ink from the reservoir to the ink pressure generating chambers 9, completing the process for manufacturing the substrate.

FIG. 3 depicts a process in which the common electrode, piezoelectric thin film, and top electrode formed on the substrate are transferred to the ink jet base 1 formed by the processes illustrated in FIG. 1. This step proceeds from A to C. B is a cross section of line A-A in A. The side opposite the nozzle holes 40 of the ink jet base 1 is allowed to adhere to the substrate by means of the adhesive layer of the substrate 60. This is depicted in A. The side of the substrate 60 where the piezoelectric thin film is not present is irradiated with the light, so as to bring about the separation in the separation layer and remove the substrate (step in B). This results in the formation of an ink jet printer head in which the PZT 4 and the top electrode 5 serving as the vibrating plate are facing the ink chambers 9. In step B in FIG. 2, an vibrating plate described below may furthermore be laminated onto the top electrode.

A specific example of the manufacture of the substrate side in this embodiment is described below. Platinum was formed by sputtering to a film thickness of 0.8 $\mu$m as a common electrode on the substrate, a piezoelectric thin film 4 was then formed thereon, and platinum was then again formed by sputtering to a film thickness of 0.1 $\mu$m as a top electrode 5 thereon. Another material with good conductivity may be used as the top electrode material, such as aluminum, gold, nickel, or indium.

A sol-gel method, which is a manufacturing method affording a thin film with a simple device, was used as the method for forming the piezoelectric thin film 4. Lead-zirconate-titanate (PZT) systems are the best among those with piezoelectric properties for use in ink jet printer heads. Upon the formation of the common electrode 3, the PZT-based sol that had been prepared was applied by spin coating and was prefired at 400° C. to form a porous amorphous gel thin film, the application of the sol and the prefiring at 400° C. were repeated twice, and a porous gel thin film was thus formed. To then obtain Perovskite crystals, RTA (rapid thermal annealing) was used to heat the material to 650° C. for 5 seconds in an oxygen atmosphere and hold it for 1 minute for annealing, resulting in a compact PZT thin film.

The step in which the sol was applied by spin coating and prefired to 400° C. was repeated three times to laminate a porous amorphous gel thin film. RTA was then used for pre-annealing at 650° C., and the material was held for 1 minute to produce a crystalline compact thin film. RTA was again used to heat the material to 900° C. in an oxygen atmosphere and hold it for 1 minute for annealing. A piezoelectric thin film 4 at 1.0 $\mu$m in thickness was thus obtained. The method for manufacturing the piezoelectric thin film can also be a sputtering method.

A negative resist 6 (HR-100, by Fuji Hunt) was then applied by spin coating onto the top electrode 5. The negative resist was exposed, developed, and baked in the desired location on the piezoelectric thin film by means of a mask, and a cured negative resist was formed. This embodiment is described with the use of a negative resist, but a positive resist can also be used.

Figures 2A, 2B, 2C, 2D:
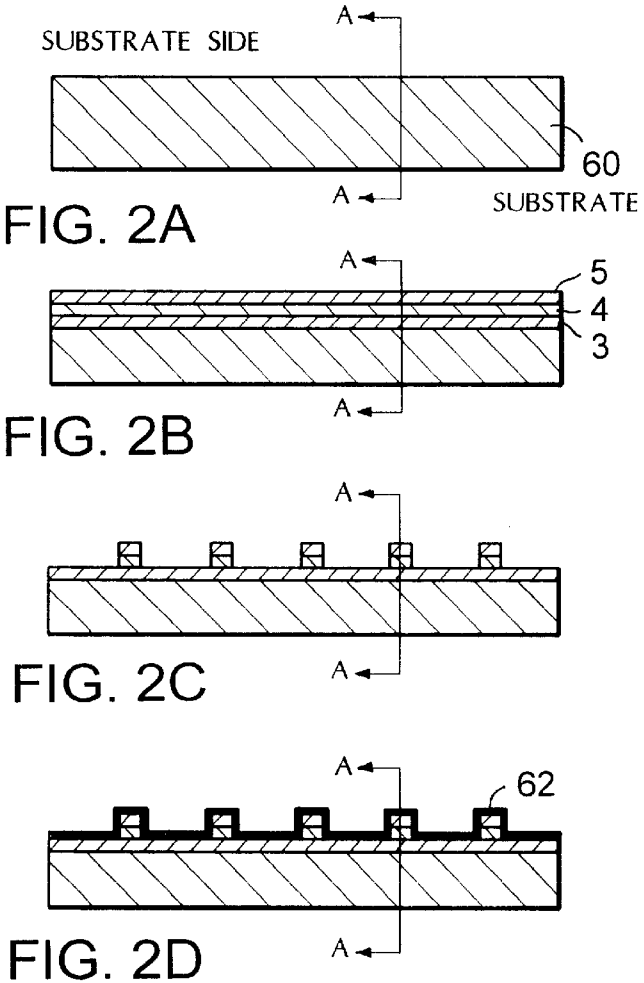

In this state, as shown in FIG. 2C, the top electrode 5 and piezoelectric thin film 4 were etched together with an etching device until the common electrode 3 was exposed, and were formed to the desired configuration formed by the negative resist. Finally, the cured negative resist was removed by an ashing device, and the patterning was completed, as shown in FIG. 2C.

As the separation layer (laser absorption layer), an amorphous silicon film was formed to a film thickness of 100 nm by low pressure CVD ($Si_2H_6$ gas, 425° C.).

In this embodiment, the nozzle holes 40 can be formed at a high density so that the ink jet base is formed while integrated with the nozzle plate by etching the photosensitive glass. For example, nozzle holes with a diameter of 20 $\mu$m can be formed at a pitch of 30 $\mu$m. The formation of nozzle holes by punching a stainless steel plate, as in the past, is disadvantageous for forming nozzle holes at a high density, and tends to result in imperfect nozzle holes because of flash. Another inconvenience is that the entire ink jet printer head must be considered defective if even one nozzle hole is clogged. It is also difficult to join the nozzle plate with the silicon forming the diaphragm of the ink pressure generating chambers. This problem may be resolved by integrally forming the nozzle plate with the ink jet base.

The ink jet base is not formed by etching the silicon in this embodiment, thus improving handling with respect to width in the heightwise direction (as indicated by L in FIG. 3C) of the ink jet base, and allowing L to be limited to a range of no more than 200 $\mu$m, and preferably between 50 and 10 $\mu$m. Since the pressure of the ink discharged from the ink pressure generating chambers is inversely proportional to the 3rd power of L, if L can be lowered, more ink can be forcefully discharged, even when the volume of the ink pressure generating chambers 9 is lower, as a result of greater dot density.

In this embodiment, the platinum of the common electrode 3 also prevents the light from reaching the PZT layer 4, even when the substrate is exposed to the radiated light, so ablation can be prevented in the PZT layer.

An adhesive layer 62 was also laminated on the substrate side, but this can also be formed on the substrate side 60 end of the ink jet base. The polysilazane described below in FIG. 5 can be used as such an adhesive layer.

An ink jet printer head with a useful structure can be formed using the method pertaining to the present invention. The ink jet printer head can be formed by bonding a common electrode 3, PZT 4, and a top electrode 5 on an ink jet base 1, and then removing a thin film device, where an ink reservoir 76 has been formed in a diaphragm 72, from a separate substrate and connecting it onto the top electrode 5.

The symbol 70 is a thin film transistor facing the ink reservoir 76, and functions as a switching element for the top electrode 5. In an ink jet printer head having such a structure, the ink supply holes are formed at the vibrating plate (common electrode) 3, so the ink channels from the ink tank to the pressure generating chambers 9 are short and are linear, allowing high drive frequencies to coexist in a high nozzle density. The common electrode can be used by itself as the vibrating plate, or it can be used with silicon nitride, zirconium, zirconia, or the like.

FIG. 5 illustrates another embodiment (sputtering) for forming an ink jet base. In this embodiment, a polysilazane quartz substrate 80 can be formed as the ink jet base by applying and solidifying polysilazane (by Tonen Kagaku KK) several tens of times on the quartz substrate 80 serving as the starting plate for the ink jet base 1.

A dry film 82 corresponding to the pattern for the nozzle jet holes 40 can be laminated onto the upper surface of the quartz substrate 80, and the dry film can be removed after the formation of the polysilazane quartz, resulting in an ink jet base 1 with nozzle jet holes 40 formed thereon.

A quartz substrate can be obtained from amorphous silicon by CVD. Because a separation layer is formed on the surface of the quartz substrate, the quartz substrate side is irradiated with light, thereby allowing the ink jet base to be separated from the quartz substrate from this portion of the separation layer 84.

This embodiment has the same effect as the previous embodiment because the ink jet base is formed with an integrated structure.

A nozzle plate may also be joined to a diaphragm, as in the past, as the ink jet base.

In the embodiments described above, amorphous silicon was selected as the ideal separation layer.

The entire disclosure of Japanese Patent Application No. 9-11724 filed on Jan. 24, 1997, including the specification, claims, drawings and summary, is incorporated herein by reference in its entirety.

As described in the embodiments above, it is possible to provide an ink jet printer head in which the material for the ink jet base is not limited, as well as a method for manufacturing the same. It is also possible to provide a method for manufacturing an ink jet printer head allowing greater dot pattern density to be achieved, as well as the ink jet printer head.

What is claimed is:

1. An ink jet head comprising:

a base having a hollow interior;

a piezoelectric element configured to separate said hollow interior into an ink pressure generating chamber and an ink reservoir; and a transistor formed opposite the piezoelectric element relative to the ink reservoir, the transistor operating the piezoelectric element, wherein the piezoelectric element has a first hole connecting the ink pressure generating chamber with the reservoir to flow ink.

2. The ink jet head according to claim 1, wherein the piezoelectric element comprises:

a vibrating plate;

a piezoelectric film formed on the vibrating plate; and an electrode formed on the piezoelectric film.

3. The ink jet head according to claim 1, wherein the base has a second hole opposite the piezoelectric element relative to the ink pressure generating chamber, the second hole being adapted to discharge ink.

4. The ink jet head according to claim 3, wherein the first hole is formed at a position offset from the second hole in a direction perpendicular to a surface of the piezoelectric element so that the first hole does not overlap the second hole.

5. The ink jet head according to claim 1, wherein the first hole is formed at a position offset from the transistor in a direction perpendicular to a surface of the piezoelectric element so that the first hole does not overlap the transistor.

6. A printer comprising an ink jet head according to claim 1.

7. A printer comprising an ink jet head according to claim 2.

8. A printer comprising an ink jet head according to claim 3.

9. A printer comprising an ink jet head according to claim 4.

10. A printer comprising an ink jet head according to claim 5.

* * * * *

UNITED STATES PATENT AND TRADEMARK OFFICE

CERTIFICATE OF CORRECTION

PATENT NO. : 6,491,384 B1
DATED : December 10, 2002
INVENTOR(S) : Takahiro Usui et al.

It is certified that error appears in the above-identified patent and that said Letters Patent is hereby corrected as shown below:

Column 1,
Line 21, “an” should be -- a --
Line 62, “wall” should be -- well --

Column 2,
Line 9, “an” should be -- a --

Column 4,
Line 34, “$BaTi_5O_1$” should be -- $BaTi_5O_{11}$ --

Column 9,
Lines 29 and 56, “an” should be -- a --

Signed and Sealed this

Fourteenth Day of October, 2003

JAMES E. ROGAN
*Director of the United States Patent and Trademark Office*